US005531269A

United States Patent [19]

Dahlgren

[11] Patent Number: 5,531,269

[45] Date of Patent: Jul. 2, 1996

[54] PLATE HEAT EXCHANGER FOR LIQUIDS WITH DIFFERENT FLOWS

[76] Inventor: Arthur Dahlgren, Klockartorpsvägen 2, S-582 75 Linköping, Sweden

[21] Appl. No.: 335,774

[22] PCT Filed: Jun. 8, 1993

[86] PCT No.: PCT/SE93/00505

§ 371 Date: Nov. 10, 1994

§ 102(e) Date: Nov. 10, 1994

[87] PCT Pub. No.: WO93/25860

PCT Pub. Date: Dec. 23, 1993

[30] Foreign Application Priority Data

Jun. 12, 1992 [SE] Sweden ..... 9201825
Jul. 3, 1992 [SE] Sweden ..... 9202057

[51] Int. Cl.[6] ..... F28F 3/08

[52] U.S. Cl. ..... 165/167; 165/DIG. 364

[58] Field of Search ..... 165/166, 167, 165/DIG. 364

[56] References Cited

U.S. PATENT DOCUMENTS

| | | | |
|---|---|---|---|
| 2,623,736 | 12/1952 | Hytte | 165/167 X |
| 3,661,203 | 5/1972 | Mesher | 165/167 |
| 3,783,090 | 1/1974 | Andersson et al. | 165/166 |
| 3,817,324 | 6/1974 | Andersson | 165/167 |
| 4,176,713 | 12/1979 | Fisher | 165/166 |
| 4,376,460 | 3/1983 | Skoog | 165/167 |
| 4,572,766 | 2/1986 | Dimitriou | 165/167 X |
| 4,605,060 | 8/1986 | Andersson et al. | 165/166 |
| 4,781,248 | 11/1988 | Pfeiffer | 165/167 |
| 4,911,235 | 3/1990 | Andersson et al. | 165/167 |
| 4,915,165 | 4/1990 | Dahlgren et al. | 165/166 |

FOREIGN PATENT DOCUMENTS

| | | | |
|---|---|---|---|
| 48148 | 4/1977 | Japan . | |
| 93291 | 5/1985 | Japan | 165/166 |
| 1677477 | 9/1991 | U.S.S.R. | 165/167 |

*Primary Examiner*—Leonard R. Leo
*Attorney, Agent, or Firm*—Fish & Richardson

[57] ABSTRACT

In a plate heat exchanger for two fluids having different flow volumes, comprising several generally rectangular heat transfer plates provided with inlet and outlet openings through its corner portions. Each heat transfer plate has a central portion and two distribution portions (15*a* and 16*a*) located between the central portion and respective inlet and outlet openings. The sizes of the inlet and outlet openings for one fluid differ from the size of the inlet and outlet openings of the other fluid. In addition, the distribution portions of the heat transfer plates provide a larger flow resistance for one fluid than the other fluid.

9 Claims, 4 Drawing Sheets

PLATE HEAT EXCHANGER FOR LIQUIDS WITH DIFFERENT FLOWS

Figure 1:
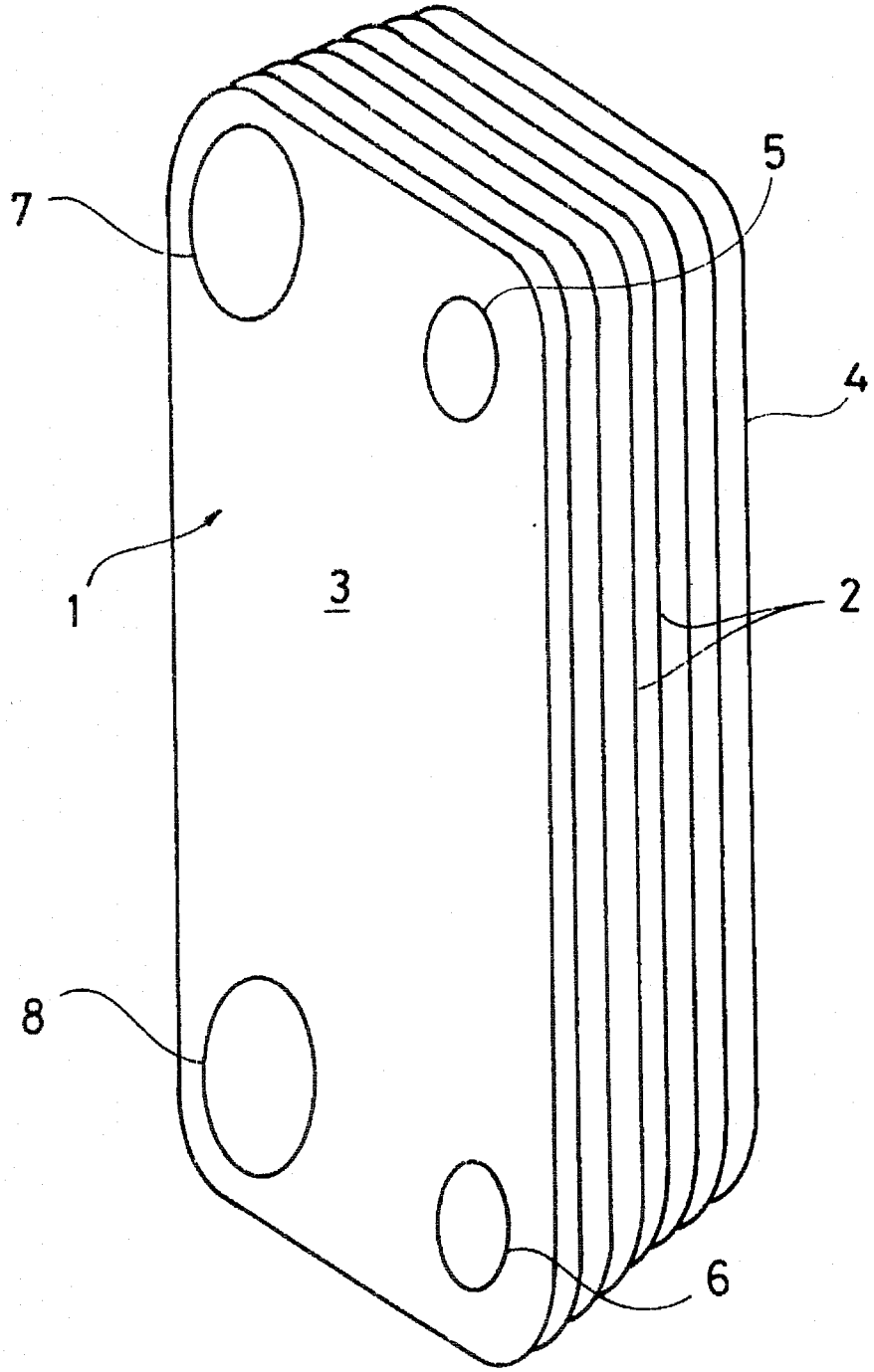

The present invention relates to a plate heat exchanger for heat transfer between two fluids having different flow volumes, comprising several principally rectangular heat transfer plates, each having inlet and outlet openings for respective fluids through its corner portions, a heat transfer portion, located centrally between respective inlet and outlet openings, and two distribution portions, located between the heat transfer portion and respective inlet and outlet openings, and being formed for distribution of the respective two fluids, when these flow from their inlet openings towards the heat transfer portions.

Traditionally formed plate heat exchangers usually have a package of identical heat transfer plates, which have inlet and outlet openings of the same kind for both of the fluids. Such a heat exchanger, having inlet and outlet openings of the same kind, is optimally used only with equal flow volume of both of the fluids. If one of the fluids has a smaller flow through the heat exchanger than the other fluid, the pressure drops of the fluids will be different, because the pressure drops alter proportionally with the square of the volume flow. This means, that the heat transfer between the fluids and the heat transfer plates cannot become optimal on both sides of each heat transfer plate, if the flows of the fluids differ.

To increase the heat transfer, in connection with a so called unsymmetrical flow between the heat exchanging fluids, it has previously been proposed to decrease the volume of the flow ducts on one side of the heat transfer plates, as disclosed in EP 470 073, or to influence the flow resistance of the flow ducts by a combination of different corrugation pattern of the heat transfer plates, as disclosed in EP 88 316 or EP 204 880. These previously proposed arrangements have in common that they only admit a small unsymmetrical flow between the two fluids and that the heat transfer regarding the heat transfer plates would not become sufficiently effective for both fluids.

An object of the present invention is to achieve an improved heat transfer between two fluids having different flow volumes in a plate heat exchanger of the described kind. An additional object is to provide a plate heat exchanger, which admits a larger unsymmetrical flow between the two fluids of different flow, compared to previously known plate heat exchangers.

These objects are attained according to the invention in that the size of the inlet and outlet openings of the heat transfer plates for a first of said two fluids is smaller than the size of the inlet and outlet openings for the other fluid, and in that the heat transfer plates in their distribution portions are so formed that the flow resistance of the first fluid, flowing between the inlet and outlet openings of first fluid and the heat transfer portions, is larger than the flow resistance of the other fluid, flowing between the inlet and outlet openings of the other fluid and the heat transfer portions.

The present invention aims at equally large pressure drops on both sides of the heat transfer plates, despite that the flows of the two heat exchanging fluids are different. Thus, for instance the flow condition of the first fluid, i.e. the fluid having the smallest flow, is optimized with respect to the heat transfer, simultaneously as the flow is simplified for the other fluid, i.e. the fluid having largest flow.

Preferable, the flow resistance can be made larger for the first fluid than for the other fluid, by making a longer flow path, at each distribution portion, for the first fluid than for the other fluid.

Also, by forming the distribution portion in such way, that the total width of the flow becomes smaller for the first fluid than for the other fluid, one can make the flow resistance larger for the first fluid than for the other fluid.

The flow resistance of the two fluids can also be made unequal, by designing the pressing pattern in the distribution portions of the heat transfer plates with smaller pressing depth on one side than on the other side of each heat transfer plate. In other words, the level of the distribution portions can be displaced in such way, that the side of the heat transfer plates, which is intended for a smaller flow will have shallower flow ducts than the side intended for a larger flow. By this, the heat transfer plates increase their possibility to provide an effective heat transfer, having large unsymmetrical flow of the two fluids.

By providing the heat transfer plates partly with inlet and outlet openings of different size, for the different fluids, and partly with a pressing pattern in the distribution portions, which give the flow through the larger openings a relatively broad inlet front and outlet front, and the flow through the smaller openings a relatively narrow inlet front and outlet front, the flow capacity may increased for the flow through the larger openings and decreased for the flow through the smaller openings. Thus, the heat transfer plates permit a strong asymmetry between the two different flows of the fluids, while for both of the fluids providing flow conditions that are favourable for the heat transfer between the fluids.

Figure 2:
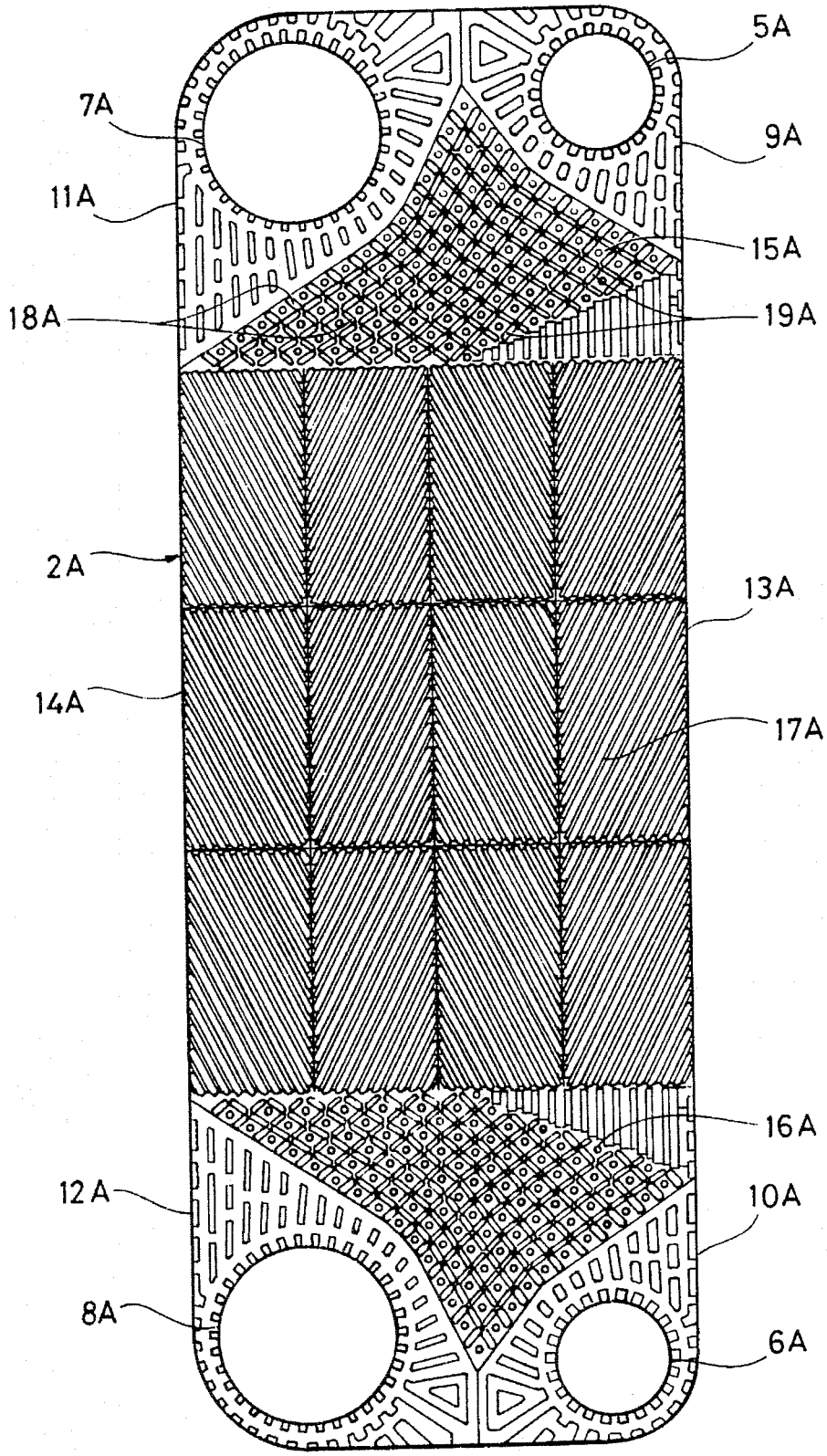
Figure 3:
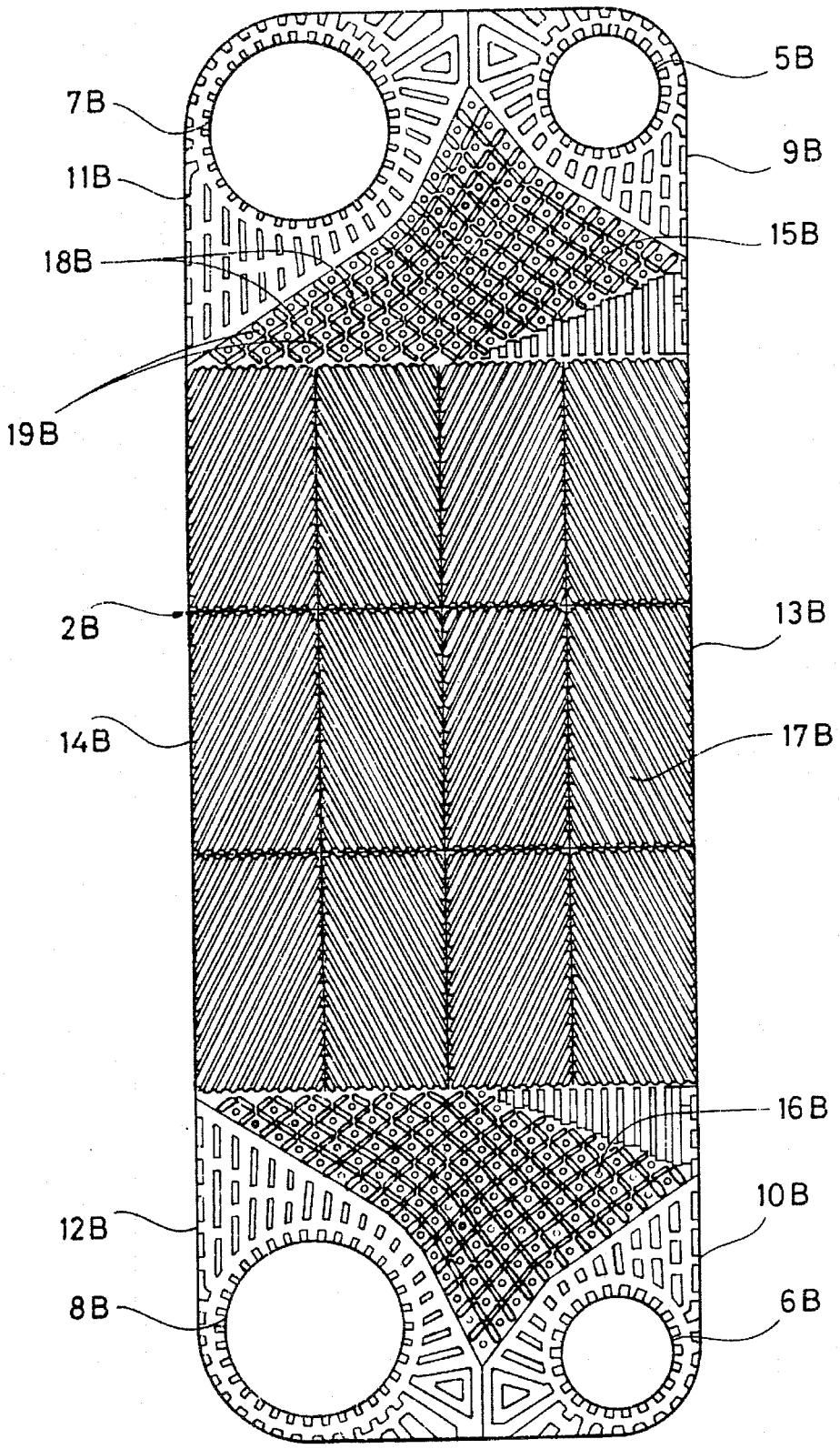
Figure 4:
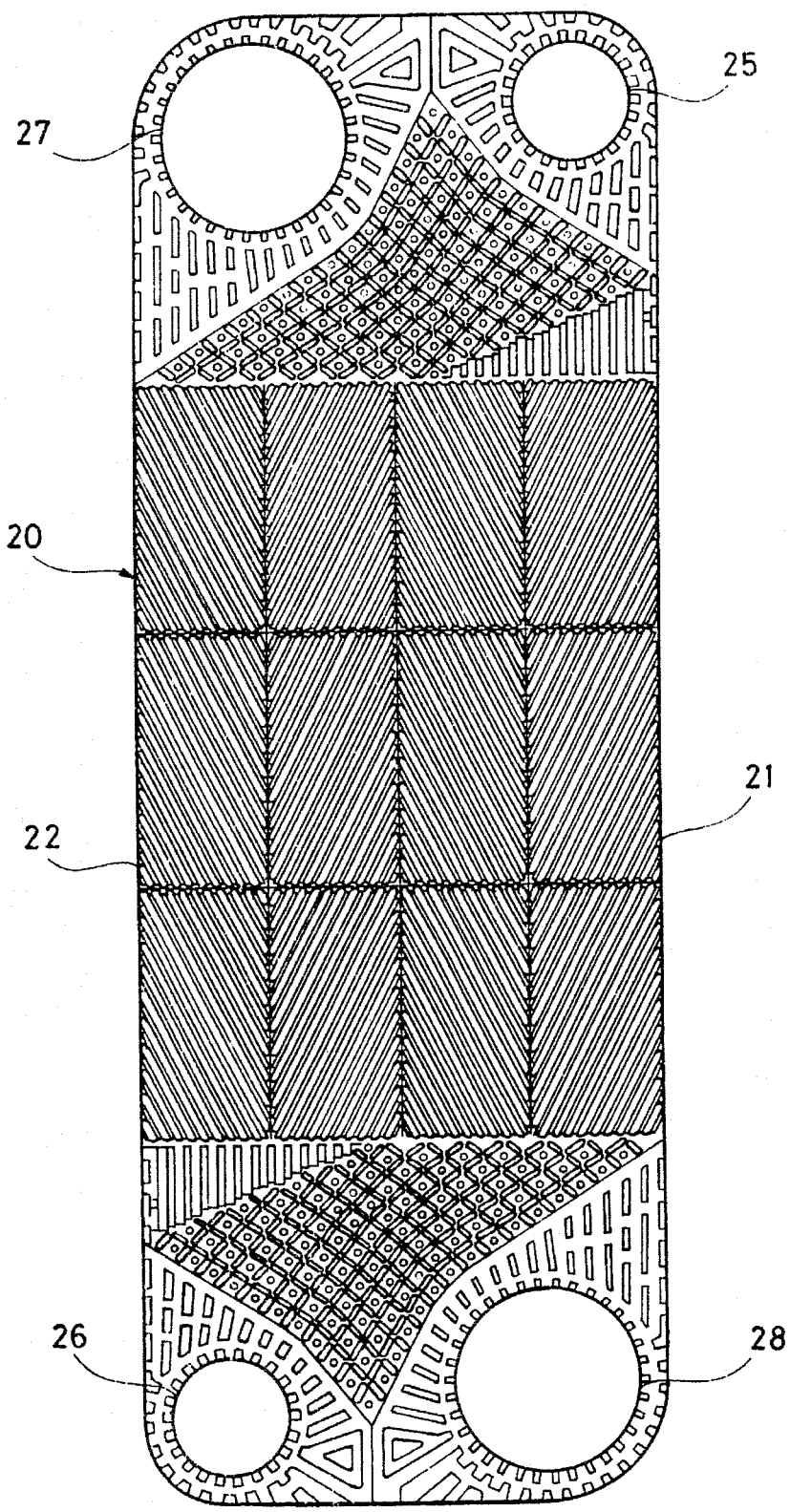

The invention will be described in the following in more detail with reference to the accompanying drawings in which FIG. 1 shows schematically a plate heat exchanger according to the invention, FIG. 2 shows a first heat transfer plate intended for the plate heat exchanger according to FIG. 1, FIG. 3 shows a second heat transfer plate intended for the plate heat exchanger according to FIG. 1, and FIG. 4 shows an alternative designed heat transfer plate intended for a plate heat exchanger according to the invention.

In FIG. 1 a plate heat exchanger 1 is shown, comprising a package of thin heat transfer plates 2, a front end plate 3 and a rear end plate 4. The front end plate 3 shows an inlet opening 5 and outlet opening 6, for a first fluid having a relatively small flow, and an inlet opening 7 and an outlet opening 8, for a second fluid having a relatively large flow.

The heat transfer plates 2 are by pressing provided with a pattern in the form of ridges and groves, the ridges of alternating first and second heat transfer plates abut towards each other. Sealing means arranged between the heat transfer plates delimits in each second plate interspace, a flow space for the first fluid, and in the remaining plate interspaces flow spaces for the other fluid.

The heat transfer plates 2 in FIG. 1 are joined by brazing, but alternatively the heat transfer plates may, in a plate heat exchanger according to the invention, be held together with help of a frame or in another suitable way.

In FIG. 2 a first heat transfer plate 2*a* is shown, which is elongated and mainly rectangular, and which has inlet and outlet openings 5*a*, 6*a* and 7*a*, 8*a*, respectively. The inlet and outlet openings are located in the corner portions 9*a*, 10*a*, 11*a* and 12*a* of the heat transfer plate. The inlet and outlet openings 5*a* and 6*a* of the first fluid are located at one long side 13*a* of the heat transfer plate and the inlet and outlet openings 7*a* and 8*a* for the other fluid are located at the other long side 14*a* of the heat transfer plate. The heat transfer plate 2*a* is designed for parallel flow, i.e. the main flow directions of the fluids, which will flow on each sides of the heat transfer plate, being parallel.

According to the invention the inlet and outlet openings 5a and 6a of the first fluid are equal, but essential smaller than the inlet and outlet openings 7a and 8a of the other fluid. Also, the inlet and outlet openings 7a and 8a are equal.

In addition the heat transfer plate 2a has an upper distribution portion 15a, a lower distribution portion 16a and arranged therebetween a portion 17a intended mainly for heat transfer.

The upper distribution portion 15a and the lower distribution portion 16a show pressing pattern formed essentially according to the content of the British patent No 1 357 282. Thus, they have adjacent each other extending ridges 18a, being upwards pressed from a plane parallel with the heat transfer plate 2a, and in angle with the ridges 18a adjacent each other extending grooves 19a downwardly pressed from said plane. Owing to that the grooves 19a form ridges on the opposite side of the heat transfer plate 2a, the heat transfer plate thus has ridges on both of its sides, which ridges together with intermediate plate portions forming ducts, for the heat transfer fluids, on respective sides of the distribution portions 15a and 16a. The ducts, thus formed, on one side of the plate are angled to the ducts, which are formed, in the same way, on the other side of the plate.

As appear from FIG. 2, the ridges 18a on the side shown, of respective distribution portions 15a and 16a, extend essentially in direction from the relatively large openings 7a and 8a towards the heat transfer portion 17a, while the grooves 19a extend essentially in direction from the relatively small openings 5a and 6a towards the heat transfer portion 17a.

The heat transfer portion 17a shows a pressing pattern in form of a conventional so-called herringbone pattern of ridges and grooves.

In FIG. 3 a second heat transfer plate 2b is shown, which is intended to cooperate with a heat transfer plate 2a according to FIG. 2, in a plate heat exchanger according to the invention. Details on the heat transfer plate 2b, which may be found on the heat transfer plate 2a, have been given the same reference numerals, but followed by "h" instead of "a".

In the heat transfer plate 2b, at each of the distribution portions 15b and 16b, the ridges 18b and 19b are formed in another way, compared to corresponding ridges 18a and 19a of the heat transfer plate 2a, in FIG. 2. Thus, the ridges 18b extend essentially in direction from the relatively small openings 5b and 6b towards the heat transfer portion 17b, while the grooves 19b extend essentially in direction from the relatively large openings 7b and 8b towards the heat transfer portion 17b.

Also the heat transfer portion 17b of the heat transfer plate 2b differs from the corresponding portion 17a of the heat transfer plate 2a, with reference to the directions of the pressed ridges and grooves of the herringbone pattern.

When two heat transfer plates 2a and 2b are located close to each other in a plate heat exchanger, the ridges on one of the plates will bear towards ridges, extending parallel thereto, on the other plate, in the areas of the distribution portions 15a, 16a and 15b, 16b, respectively, of the plates. In the area of the heat transfer portions 17a and 17b, the ridges in the herringbone pattern of the plates will crossingly bear towards each other and form a so-called cross corrugation pattern.

Two heat transfer plates, which heat transfer portions cooperate to cause a cross corrugation pattern, in which obtuse angles are formed between each other crossing ridges, viewed in the flow direction of a fluid flowing between the plates, provide a very large flow resistance to the fluid. The distribution portions of the heat transfer plates give, in this case, normally by percentage a very small contribution to the flow resistance in the plate interspace, despite that the flow velocity, due to the geometry of the heat transfer plates, is about twice as large in the area of the distribution portions as in the area of the main heat transfer portion.

Heat transfer portions having a herringbone pattern, which instead forms a corresponding acute angle between each other crossing ridges give, on the contrary, a small flow resistance, and the distribution portions contribution to the flow resistance in a plate interspace may then become, by percentage, proportionately large.

According to the invention, an asymmetry is elucidated between the flow of two heat exchanging fluids, by making the flow resistance smaller for the relatively large flow than for the relatively small flow. This is accomplished by making the inlet and outlet openings, for the large flow, of the heat transfer plates, larger than for the small flow and by making the distribution portions broader and shorter for the large flow on expense of a corresponding prolongation and reduction of the width for the small flow.

For instance, in the distribution portions 15a and 16a the flow of the fluid through the relatively large inlet and outlet openings 7a and 8a are given a broad inlet and outlet front, i.e. the total flow width is larger on one side of the heat transfer plates, which is intended for the relatively large flow and smaller on the side of heat transfer plate, which is intended for the relatively small flow.

In addition, the flow ducts of the distribution portions 15a and 16a are longer for the small flow compared to the large flow.

In a pressing pattern for the distribution portions, of the kind shown in FIGS. 2 and 3, the through-flow area of the ducts for the large flow (on the one side of a plate) may be made further larger at the expense of the through-flow area of the ducts for the small flow (on the other side of the plate) by locating the plate portions, which are between the upwardly pressed ridges and the downwardly pressed grooves, closer to the bottom of the grooves than the top of the ridges.

In FIG. 4, an alternative designed heat transfer plate 20 is shown, which differs from the heat transfer plate 2a, shown in FIG. 2, mainly by the fact that an inlet opening 25 for a first fluid is located at one long side 21 of the heat transfer plate, that an outlet opening 26 for the same fluid is located at the second long side 22 of the heat transfer plate, that an inlet opening 27 for a second fluid is located at said one long side 21 of the heat transfer plate and that an outlet opening 28 for the other fluid is located at the second long side 22 of the heat transfer plate. The heat transfer plate 20 is designed for a so-called diagonal flow, i.e. the main flow direction of the fluids cross each other and each runs diagonally over the heat transfer plate 20.

In connection with diagonal flow, two different kinds of heat transfer plates (having different pressing pattern) are required to provide a desired cooperation between the pressing pattern of adjacent plates in a plate heat exchanger. The function according to the invention of as well the central heat transfer portions as the distribution portions are, in plates intended for diagonal flow (FIG. 4), analogous to the plates intended for parallel flow (FIGS. 2 and 3).

In connection with parallel flow, a plate heat exchanger according to the invention can be obtained by means of only one kind of plates provided with identically pressing pattern at the distribution portions and at the heat transfer portions, if alternate plate is turned relatively the remaining plates 180° around an axis in the plane of the plate. This requires, however, special requirements on the arrangement, for sealing between the plates, along its edges and around its inlet and outlet openings.

A combination of 50% broader front for the larger flow Than for the smaller flow, in the areas of the distribution portions of the heat transfer plates, and 50% longer ducts for the smaller flow than for the larger flow may double the flow capacity of the ducts for the larger flow than of the ducts for the smaller flow, at the same pressure drop for both of the flows through the respective plate interspace.

In a combination with shallower ducts for the smaller flow and deeper ducts for the larger flow, an asymmetry has been provided, having the proportion 3:1 between the larger and the smaller flow in the area of the distribution portions.

When the heat transfer portion has a herringbone pattern with acute angles, and thus providing a relatively small flow resistance, the proportion 3:1 of the heat exchanging fluids may be attained through the whole plate heat exchanger.

When the heat transfer portion has a herringbone pattern with obtuse angles, and thus providing a relatively large flow resistance, the proportion 1.2–1.5:1 of the heat exchanging fluids may be achieved between the larger and the smaller flows through the plate heat exchanger.

In a plate heat exchanger according to the invention on both sides of the heat transfer plates the pressure drop of the flowing heat exchanging fluid may be maintained, in spite of different flows. This has been made possible by giving the flow path of the fluid, having the relatively small flow, smaller through flow areas, than the corresponding flow path in a conventional plate heat exchanger, having equally large inlet and outlet openings in the heat transfer plates. This has, for its part, made it possible that the flow path of the fluid, having the relatively large flow, be given larger through flow areas than corresponding flow path of a conventional plate heat exchanger. With this, a plate heat exchanger according to the invention could in part be given a larger flow capacity on the high flow side than a conventional plate heat exchanger, and in part could be given an essential larger heat transfer capacity than a conventional plate heat exchanger in connection with a certain asymmetry of the flow of the heat exchanging fluids.

Such a larger heat transfer capacity of the heat transfer plates can be used in different ways. Thus for a certain heat exchange task, a plate heat exchanger according to the invention, may use fewer heat transfer plates than a conventional plate heat exchanger, or each heat transfer plate may be made smaller compared to a heat transfer plate designed in a conventional way. In the latter case, besides the cost for the heat transfer plates, also the costs for a frame, holding together the package of heat transfer plates, may be reduced. For instance, in the latter case elongated heat transfer plates formed according to the invention can be made thinner than corresponding conventional heat transfer plates. Also a frame can be made thinner and thus cheaper.

An advantage of the invention is also that the actions to simplify asymmetry of the flow of the fluids may be made without compromising the ability of the heat transfer plates to withstand high fluid pressure, while maintaining the thickness of the plates. Support points and contact points between the heat transfer plates can lay as close as in conventional heat transfer plates.

Only one kind of pressing pattern for the distribution portions of the heat transfer plates and one kind of pattern for the heat transfer portions of the plates has been described above. Within the frame of the invention, as described in the following patent claims, of course other suitable pressing patterns would be possible.

I claim:

1. A plate heat exchanger for heat transfer between two fluids having different flow volumes, comprising several principally rectangular heat transfer plates (2*a*, 20), each having inlet and outlet openings (5*a*, 6*a* and 7*a*, 8*a*; 25, 26 and 27, 28) for respective fluids through its corner portions (9*a*, 10*a*, 11*a*, 12*a*), a heat transfer portion (17*a*), located centrally between respective inlet and outlet openings, and two distribution portions (15*a*, 16*a*), located between the heat transfer portion (17*a*) and respective inlet and outlet openings and being formed for distribution of the respective two fluids flowing from their inlet openings towards the heat transfer portions, characterized in that the size of the inlet and outlet openings (5*a*, 6*a*; 25, 26) of the heat transfer plates for the first of said two fluids is smaller than the size of the inlet and outlet openings (7*a*, 8*a*; 27, 28) for the other fluid and that the heat transfer plates in their distribution portions are so formed that the flow resistance for the first fluid, flowing between the inlet and outlet openings (5*a*, 6*a*; 25, 26) of the first fluid and the heat transfer portions (17*a*), is larger than the flow resistance for the other fluid, flowing between the inlet and outlet openings (7*a*, 8*a*; 27, 28) of the other fluid and the heat transfer portions (17).

2. Plate heat exchanger according to claim 1, characterized in that the heat transfer plates are elongated and that the inlet and outlet openings (5*a*, 6*a*) for the first fluid are located at one long side (13*a*) of each heat transfer plate and the inlet and outlet openings (7*a*, 8*a*) for the other fluid are located at the second long side (14*a*) of each heat transfer plate.

3. Plate heat exchanger according to claim 1, characterized in that the inlet and outlet openings (25–28) of the heat transfer plates are located in such way that the two main flow directions for the flow of the fluids between the heat transfer plates cross each other and extend diagonally over the heat transfer plates.

4. A plate heat exchanger for heat transfer between two fluids having different flow volumes, comprising several principally rectangular heat transfer plates (2*a*, 20), each having inlet and outlet openings (5*a*, 6*a* and 7*a*, 8*a*; 25, 26 and 27, 28) for respective fluids through its corner portions (9*a*, 10*a*, 11*a*, 12*a*), a heat transfer portion (17*a*), located centrally between respective inlet and outlet openings, and two distribution portions (15*a*, 16*a*), located between the heat transfer portion (17*a*) and respective inlet and outlet openings and being formed for distribution of the respective two fluids flowing from their inlet openings towards the heat transfer portions, characterized in that the size of the inlet and outlet openings (5*a*, 6*a*; 25, 26) of the heat transfer plates for the first of said two fluids is smaller than the size of the inlet and outlet openings (7*a*, 8*a*; 27, 28) for the other fluid and that the heat transfer plates in their distribution portions are formed so that the flow path between the inlet and outlet openings of the first fluid and the heat transfer portions (17*a*) is longer than the flow path for the other fluid between the inlet and outlet openings (7*a*, 8*a*; 27, 28) of the other fluid and the heat transfer portions.

5. Plate heat exchanger according to claim 4, characterized in that the heat transfer plates are elongated and that the inlet and outlet openings (5*a*, 6*a*) for the first fluid are located at one long side (13*a*) of each heat transfer plate and the inlet and outlet openings (7*a*, 8*a*) for the other fluid are located at the second long side (14*a*) of each heat transfer plate.

6. Plate heat exchanger according to claim 4, characterized in that the inlet and outlet openings (25–28) of the heat transfer plates are located in such way that the two main flow directions for the flow of the fluids between the heat transfer plates across each other and extend diagonally over the heat transfer plates.

7. A plate heat exchanger for heat transfer between two fluids having different flow volumes, comprising several principally rectangular heat transfer plates (2*a*, 20), each having inlet and outlet openings (5*a*, 6*a* and 7*a*, 8*a*; 25, 26 and 27, 28) for respective fluids through its corner portions (9*a*, 10*a*, 11*a*, 12*a*), a heat transfer portion (17*a*), located centrally between respective inlet and outlet openings, and two distribution portions (15*a*, 16*a*), located between the heat transfer portion (17*a*) and respective inlet and outlet openings and being formed for distribution of the respective two fluids flowing from their inlet openings towards the heat transfer portions, characterized in that the size of the inlet and outlet openings (5*a*, 6*a*; 25, 26) of the heat transfer plates for the first of said two fluids is smaller than the size of the inlet and outlet openings (7*a*, 8*a*; 27, 28) for the other fluid and that the heat transfer plates in their distribution portions are formed to provide a flow path for the first fluid, flowing between the inlet and outlet openings (5*a*, 6*a*; 25, 26) of the first fluid and the heat transfer portions, which is wider than the flow path for the other fluid, flowing between the inlet and outlet openings (7*a*, 8*a*; 27, 28) of the other fluid and the heat transfer portions.

8. Plate heat exchanger according to claim 7, characterized in that the heat transfer plates are elongated and that the inlet and outlet openings (5*a*, 6*a*) for the first fluid are located at one long side (13*a*) of each heat transfer plate and the inlet and outlet openings (7*a*, 8*a*) for the other fluid are located at the second long side (14*a*) of each heat transfer plate.

9. Plate heat exchanger according to claim 7, characterized in that the inlet and outlet openings (25–28) of the heat transfer plates are located in such way that the two main flow directions for the flow of the fluids between the heat transfer plates across each other and extend diagonally over the heat transfer plates.

* * * * *

UNITED STATES PATENT AND TRADEMARK OFFICE

CERTIFICATE OF CORRECTION

PATENT NO. : 5,531,269

DATED : July 2, 1996

INVENTOR(S) : Arthur Dahlgren

It is certified that error appears in the above-identified patent and that said Letters Patent is hereby corrected as shown below:

| | |
|---|---|
| Col. 1, line 19, | Cancel "volume" and substitute --volumes-- |
| Col. 2, line 21 | Insert --be-- before "increased" |
| Col. 3, line 38 | Cancel "h" and substitute --"b"-- |
| Col. 3, line 39 | Cancel "a" and substitute --"a"-- |
| Col. 5, line 5 | Cancel "Than" and substitute --than-- |

Signed and Sealed this

Third Day of June, 1997

*Attest:*

*Attesting Officer*

Bruce Lehman

BRUCE LEHMAN

*Commissioner of Patents and Trademarks*